US006831240B2

(12) United States Patent
Bach et al.

(10) Patent No.: US 6,831,240 B2
(45) Date of Patent: Dec. 14, 2004

(54) DRIVE TRAIN FOR A DISPLACEABLE CONTACT ON AN ELECTRICAL POWER BREAKER

(75) Inventors: Michael Bach, Berlin (DE); Jörg-Uwe Dahl, Werder (DE); Ludvik Godesa, Berlin (DE); Ralph Hohenberger, Brieselang (DE); Marc Liebetruth, Glienicke (DE); Detlev Schmidt, Berlin (DE); Günter Seidler, Berlin (DE); Ingo Thiede, Berlin (DE); Sezai Türkmen, Belin (DE); Artur Wajnberg, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 17 days.

(21) Appl. No.: 10/432,643

(22) PCT Filed: Nov. 20, 2001

(86) PCT No.: PCT/DE01/04421

§ 371 (c)(1),
(2), (4) Date: May 23, 2003

(87) PCT Pub. No.: WO02/43096

PCT Pub. Date: May 30, 2002

(65) Prior Publication Data

US 2004/0134764 A1 Jul. 15, 2004

(30) Foreign Application Priority Data

Nov. 24, 2000 (DE) ..... 100 60 195

(51) Int. Cl.[7] ..... H01H 3/00
(52) U.S. Cl. ..... 200/400
(58) Field of Search ..... 200/400, 401, 200/500, 501, 318, 323–327, 331, 288; 335/6, 15, 16, 46, 195

(56) References Cited

U.S. PATENT DOCUMENTS

| | | | | | |
|---|---|---|---|---|---|
| 4,260,865 | A | * | 4/1981 | Horiuchi | 200/320 |
| 4,468,533 | A | * | 8/1984 | Kodera et al. | 200/400 |
| 4,611,187 | A | | 9/1986 | Banfi | |
| 4,713,503 | A | * | 12/1987 | Kamp | 218/140 |
| 5,326,950 | A | * | 7/1994 | Lammers et al. | 200/469 |
| 6,084,489 | A | * | 7/2000 | Castonguay et al. | 335/167 |
| 6,160,234 | A | * | 12/2000 | Wehrli et al. | 200/400 |
| 6,384,356 | B1 | * | 5/2002 | Postmus et al. | 200/402 |
| 6,515,245 | B2 | * | 2/2003 | Marin-Pache et al. | 200/400 |

FOREIGN PATENT DOCUMENTS

| | | |
|---|---|---|
| DE | 4416091 | 4/1998 |
| DE | 19739702 | 5/2002 |
| EP | 0918348 | 5/1999 |

* cited by examiner

*Primary Examiner*—Michael A. Friedhofer
(74) *Attorney, Agent, or Firm*—Harness, Dickey & Pierce, P.L.C.

(57) ABSTRACT

A drive train is for a displaceable contact on a breaker contact arrangement in an electrical power breaker. A coupling element displaceable against a stop and arranged between the moveable contact and corresponding drive element is provided with an anti-bounce device, including a catch element and a counter piece. The catch element which may be swung into a catch position as a result of the inertia exerted on the centre of gravity thereof, when the coupling element strikes the stop, includes a working surface extending in the pivoting direction to forma momentary working connection with the counter piece. A retaining spring is additionally provided on the catch element to guarantee that a rebounding of the coupling element into the position corresponding to the close state of the breaker contact arrangement does not occur.

20 Claims, 3 Drawing Sheets

DRIVE TRAIN FOR A DISPLACEABLE CONTACT ON AN ELECTRICAL POWER BREAKER

This application is the national phase under 35 U.S.C. § 371 of PCT International Application No. PCT/DE01/04421 which has an International filing date of Nov. 20, 2001, which designated the United States of America and which claims priority on German Patent Application number DE 100 60 195.2 filed Nov. 24, 2000 the entire contents of which are hereby incorporated herein by reference.

FIELD OF THE INVENTION

The invention generally relates to the field of electrical switches. It is applicable, for example, to the design configuration of a drive train for the opening and closing process of a moving contact of a switching contact arrangement for an electrical switch, in which a coupling element, arranged between the moving contact and associated drive element and movable against a stop at the end of the opening process, includes an associated bouncing protection device including a catching element and a fixed-position opposing piece.

BACKGROUND OF THE INVENTION

In a known electrical switch, the catching element includes a single-armed lever which is arranged such that it can pivot on the coupling element and is subject to the force of the setting spring. This means that the center of gravity of the catching element is not on its pivoting axis, so that, when the coupling element strikes the stop, the catching element can be pivoted to a catching position by the inertia force acting at its center of gravity (U.S. Pat. No. 4,468,533).

In the case of drive trains of this type, the elements of the drive rods are accelerated nonuniformly during the opening process and, in the process, the catching element (which has a working surface in order to form a temporary operative connection to the opposing piece) is pivoted from its rest position opposite the coupling element even before the coupling element strikes the stop, in such a way that it does not produce the necessary operative connection to the opposing piece. In the absence of the operative connection, the coupling element which strikes the stop can bounce back without any impediment to its position corresponding to the closed position of the switching contact arrangement, thus resulting in a risk of increased contact wear, or even of welding of the contacts. In this case, the bouncing of the coupling element when it strikes the stop is dependent on the level of the current to be interrupted and on the level of the electrodynamic forces which are caused by this current, act on the elements of the drive train and result in the elements of the drive train being moved more quickly during the opening process. For normal operating currents, the acceleration which is produced (the angular acceleration in the case of a coupling element which can move about a rotation axis) and hence the inertia force acting at the center of gravity of the catching element are less then, for example, in the event of high short-circuit currents.

In the case of the known switch (U.S. Pat. No. 4,468,533) which has been mentioned, the catching element (which is in the form of a lever) is firmly seated on a drive element in the form of a switching shaft. The catching element is in this case mounted on the coupling element such that the pivoting axis of the catching element is radially separated from the rotation axis of the switching shaft. In order to pivot the catching element to its catching position if the coupling element bounces, the radial extent of the catching element corresponds approximately to that of the coupling element, and thus requires a correspondingly large physical space and pivoting space within the drive train. In order to position the catching element accurately in its catching position, the catching element has a stop surface, which is associated with the opposing piece, in addition to the working surface.

The working surface, which runs at right angles to this stop surface, is pushed against the opposing piece if the coupling element bounces, assuming that the lever is positioned accurately in its catching position, thus preventing excessive bouncing of the coupling element. In order to position it in this way, it is necessary for the spring force of the resetting spring to be matched to the inertia force, which acts at the center of gravity of the catching element and is dependent on the acceleration of the coupling element, such that the stop surface of the catching element reliably makes contact with the opposing piece as a result of the coupling element striking the stop. The spring force can be matched in such a way only for a limited range of inertia forces. If the current forces which produce an inertia force are greater, with their value being outside this limited range, the angular acceleration and hence the angular velocity of the catching element when the stop surface strikes the opposing piece may be so great that the catching element bounces off the opposing piece (secondary bouncing), and the working surface cannot make the necessary operative connection to the opposing piece.

SUMMARY OF THE INVENTION

An embodiment of the invention is based on an object of designing the bouncing protection device so as to prevent the coupling element from bouncing back to a position which corresponds to the closed position of the switching contact arrangement, throughout the entire power range of the switch, that is to say from normal operating currents up to the maximum short-circuit currents.

According to an embodiment of the invention, an object may be achieved in that the catching element is additionally associated with a hold-back element, on which the catching element is guided during the opening process and, in the process, is held in its rest position opposite the coupling element until the coupling element reaches a predetermined position.

A catching element which is provided with a hold-back element in this way is guided during the opening process, irrespective of the nature and the value of the acceleration of the elements of the drive train, so as to reliably prevent uncontrolled deflection from its rest position as a result of non-uniform acceleration, such as that which occurs by way of example in the case of rapidly successive OFF-ON-OFF switching processes.

One development of an embodiment of the invention provides for the catching element to be in the form of a single-armed, hook-like lever, and for it to be possible for this lever to engage behind the opposing piece.

In an embodiment such as this, in which the working surface is drawn against the opposing piece when the coupling element bounces, the radial extent of the catching element may be designed to be so short that its installation space and pivoting space are not restricted by any other, for example by the drive element. In particular, the radical extent of the catching element in the case of a coupling element which is in the form of a lever arranged in a fixed position on a switching shaft may be shorter than the distance between the pivoting axis of the catching element and the rotation axis of the coupling element. The catching element may be fitted at different positions on the coupling element. A bouncing protection device such as this can thus advantageously be used in drive trains in which only a small physical space is available for the bouncing protection device. It can also be used in drive trains in which the coupling element carries out a linear movement.

The catching element may also be designed such that its working surface is pushed against the opposing piece in the event of bouncing, in a similar way to that with the known drive train (U.S. Pat. No. 4,468,533). However, for this purpose, the catching element must be in the form of a two-armed lever, in which the working surface is formed on one lever arm and the center of gravity is located in the area of the other lever arm. A two-armed lever such as this can likewise be used in drive trains in which the coupling element carries out a linear movement.

It is advantageous for the catching element to be able to pivot freely through a pivoting angle of at least 45° in order to form the temporary operative connection, and for the working surface to extend over a circular arc angle of at least 20°. With a refinement such as this, catching takes place without the catching element running against a stop and, in consequence, not being able to bounce back itself. This is ensured in that, firstly, the catching element can pivot freely through a pivoting angle which is greater than that previously known and in that, secondly, the working surface extends over a relatively large circular arc angle. In consequence, in the event of high short-circuit currents, the catching element can pivot through a greater pivoting angle to its catching position than, for example, for normal operating currents. In any case, the catching element is held securely in its catching position by the interaction of the spring force of the resetting spring, which rises during pivoting of the catching element, and the friction force, which acts between the working surface and the opposing piece in the event of any bouncing of the coupling element which still occurs during the pivoting movement of the catching element.

A physically simple embodiment of the new drive train is characterized in that the hold-back element is in the form of a spring. In this case, the spring may be designed such that, once the coupling element has moved through a predetermined position, in particular when the moving coupling element strikes the stop, the catching element is accelerated by the spring in the direction of its catching position.

A further preferred embodiment of the new drive train is distinguished by the hold-back element in the form of a rigid part, which is provided with a slotted-link guide and is held on the drive train, in particular on a coupling member which is hinged on the coupling element. The rigid part may also be integrally formed, for example on the coupling member. In this case, the movement of the catching element can be controlled by a slotted-link guide curved in the form of a circular arc, if two coupling bolts pass through the rigid part, and with one coupling bolt coupling the coupling member to a contact lever support to which the moving contact is fitted, and the other coupling bolt coupling the coupling member to the coupling element.

BRIEF DESCRIPTION OF THE DRAWINGS

The invention will be explained in more detail in the following text with reference to the drawing, in which.

DETAILED DESCRIPTION OF THE PREFERRED EMBODIMENTS

Figure 1:
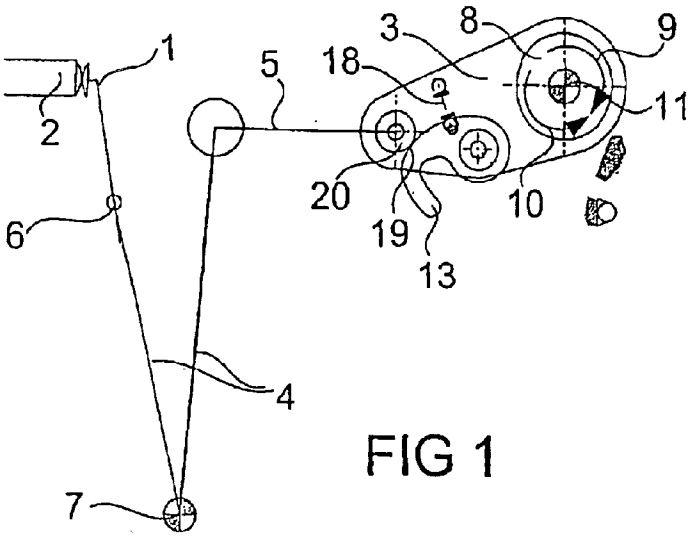
FIGS. 1 to 3 show a first embodiment of a catching element, which is hinged on a coupling element in such a way that it can pivot in the counterclockwise direction to its catching position.

As shown in FIGS. 1 to 6, the new drive train for a moving contact 1 of a switching contact arrangement, which includes this moving contact 1 and a fixed-position contact 2 which is associated with it, for an electrical switch has a contact element 3, a contact support 4 and a contact member 5. In this case, the moving contact 1 is in the form of a contact lever, which is arranged on the contact support 4 such that it can pivot about a first pivoting bearing 6. The contact support 4 can pivot about a second pivoting bearing 7. The coupling element 3 is in the form of a lever and is arranged fixed on a drive element 8 in the form of a switching shaft. The coupling member 5 is connected to the contact support 4 by way of a first coupling bolt 33, and is connected to the coupling element 3 by way of a second coupling bolt 34.

As is shown in FIG. 1, the moving contact 1 is pressed against the fixed-position contact 2 when the switching contact arrangement is in the connected position. Two or more moving contacts may also be mounted in a known manner in the contact support 4 in this case, such that they can pivot parallel to one another. In order to close the switching contact arrangement, the switching shaft 8 can be rotated in a known manner by means of a drive apparatus, which is not illustrated, in a connection direction 9 and can be latched in, a connected position, with the switching contact arrangement being closed when the switching shaft is in the connected position. Releasing the catch for the switching shaft allows the switching shaft to move in the direction 10 of a disconnected position (see FIG. 2). During the opening process, the electrodynamic forces produced by the current forces cause the elements of the drive train to accelerate in a direction which corresponds to the opened position of the switching contact arrangement and, in the process, the coupling element 3, which is arranged fixed on the switching shaft 8, pivots about the rotation axis 11 of the switching shaft.

Figure 2:
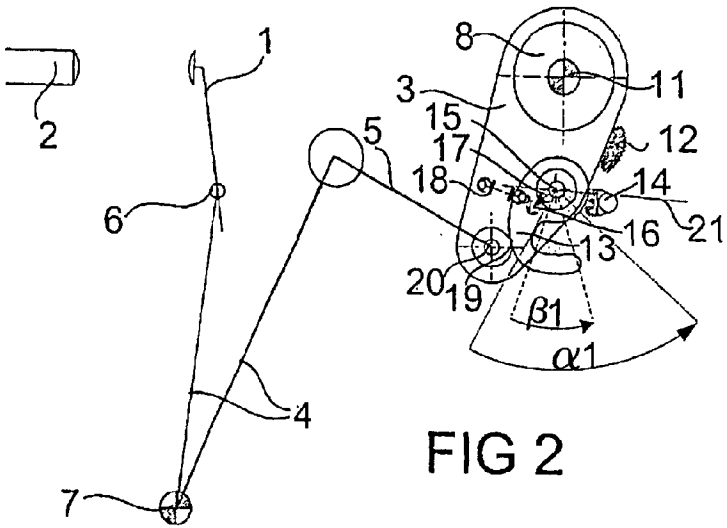

As is shown in FIG. 2, the coupling element 3 strikes a stop 12 at the end of the opening process, when the switching shaft 8 is in the disconnected position. In order to prevent the coupling element 3 from bouncing in the direction of the closed position of the switching contact arrangement, the coupling element 3 has an associated bouncing protection device, which has a catching element 13, a hold-back element (which is not shown in FIGS. 1 to 4) which is associated with the catching element, and a fixed-position opposing piece 14. The catching element is in this case in the form of a single-armed, hook-like lever, and is attached to the coupling element 3 such that it can pivot about a pivoting axis 15 which runs parallel to the rotation axis 11 of the switching shaft 8. The fact that the catching element 13 is in the form of a single-armed lever ensures that its center of gravity 16 is at a certain radial distance 17 from the pivoting axis 15.

The catching element 13 has a rest position opposite the coupling element in which it is supported by means of a stop surface 19 on a bolt 20, which passes through the coupling element, under the influence of the force of a resetting spring 18, when the coupling element is at rest (see FIG. 1). During the uniform acceleration during the opening process, the catching element 13 remains in its rest position until the coupling element 3 strikes the stop 12, owing to the inertia force which is produced by the accelerated movement and acts at its center of gravity 16. The hold-back element is used to ensure that the catching element is held securely in the rest position opposite the coupling element even if the accelerated movement of the elements of the drive train takes place in a non-uniform manner (see FIGS. 5 and 6).

In this rest position, the center of gravity 16 of the catching element 13 and the rotation axis 11 of the coupling element 3 are located on both sides of a surface 21, which rests tangentially on the movement path of the pivoting axis 15. This rest position is also characterized in that the inertia force which acts when the coupling element 3 strikes the stop 12, that is to say when the coupling element is stopped suddenly, is converted optimally into the pivoting movement of the catching element 13 about its pivoting axis 15.

Figure 3:
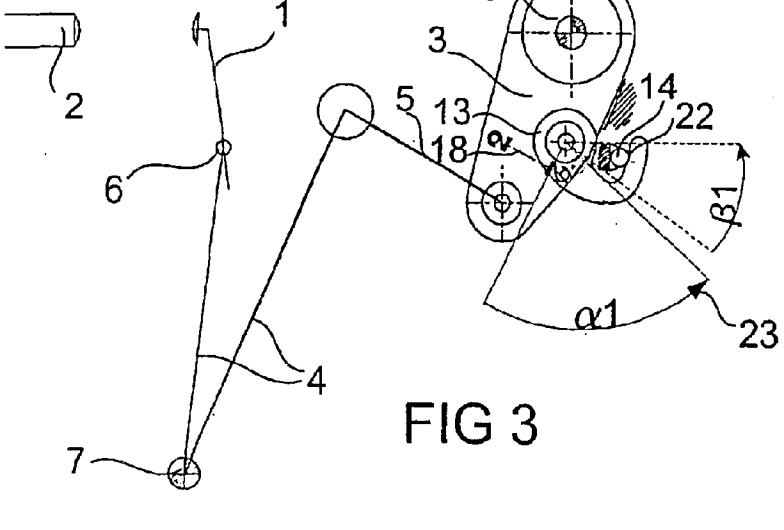

As can be seen from FIG. 3, when the coupling element 3 strikes the stop 12, the inertia force acts on the catching element 13 such that the catching element 13 is pivoted from its rest position through a pivoting angle $\alpha 1$ (see also FIG. 2) to a catching position, against the spring force of the resetting spring 18, which rises during the pivoting process. This pivoting angle $\alpha 1$ should not be greater than 100° and, in the present situation, is about 80°. In order to form a temporary operative connection to the opposing piece 14, the catching element 13 has a working surface 22 which extends over a circular arc $\beta 1$ of approximately 30°. This circular arc $\beta 1$ may also be chosen to be smaller if the spring force of the resetting spring 18 is correspondingly greater and/or for a switch with a lower rating range, but it should not be less than 20° and does not need to be more than 45°.

The operative connection is produced by the catching element 13 being drawn against the opposing piece 14 when the coupling element 3 bounces, thus blocking any further movement of the coupling element 3 in the direction of the closed position of the switching contact arrangement. The operative connection is produced on the basis of the relatively long working surface 22 and of the force (which has a braking effect) of the resetting spring 18 between the catching element 13 and the opposing piece 14, without the catching element 13 striking the opposing piece 14 in its pivoting direction 23. As soon as the movement energy of the coupling element that has resulted in bouncing is sufficiently dissipated via the operative connection, the catching element returns to its rest position under the force of the resetting spring 18. The elements of the drive train can thus once again move in the direction of the closed position of the switching contact arrangement.

Figure 4:
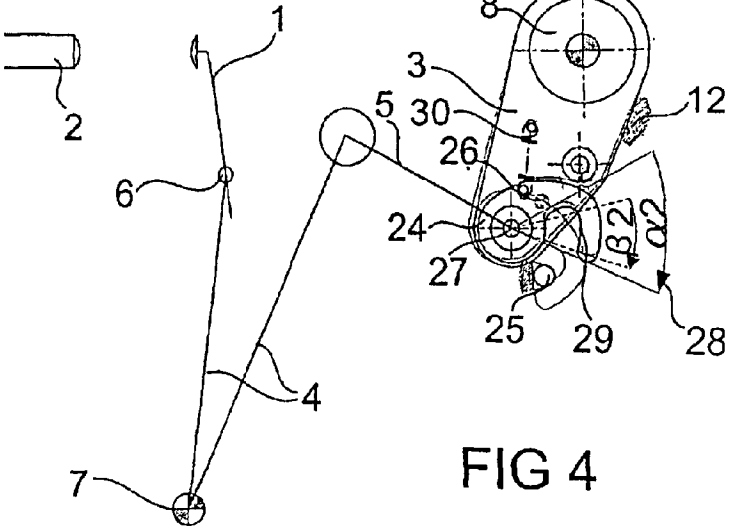
FIG. 4 shows the catching element as shown in FIGS. 1 to 3, but hinged in such a way that it can pivot in the clockwise direction to its catching position.

As can be seen from FIG. 4, when the catching element 24 is in its rest position, it can also be arranged on the coupling element 3 such that, when the coupling element 3 strikes the stop, it is pivoted outward and hence in the clockwise direction, and the opposing piece 25 must be arranged in an appropriate manner for this purpose. Another characteristic feature of this arrangement is that the center of gravity 26 is arranged such that the inertia force which acts on the stop 12 when the coupling element 3 strikes the stop, against the force of the resetting spring 30, is optimally converted into a pivoting movement of the catching element about its pivoting axis 27 in the pivoting direction 28, that is to say in the direction of its catching position. In this case, the pivoting angle $\alpha 2$ of the catching element 24 is about 50°. The working surface 29 extends over a circular arc angle $\beta 2$ of about 30°.

Figure 5:
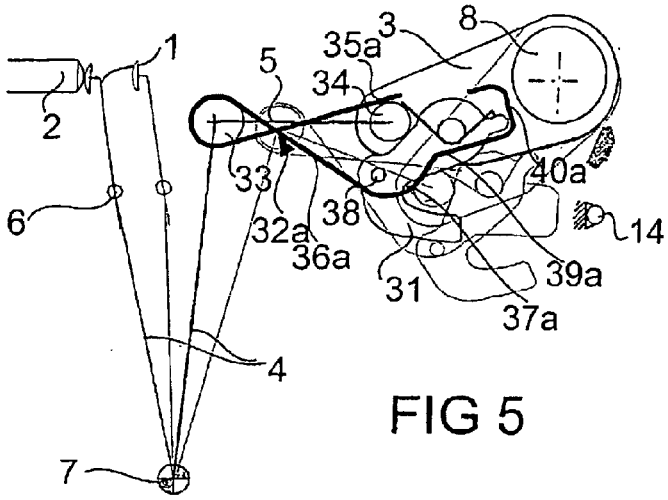
FIGS. 5 to 10 show a second embodiment of the catching element, with the hold-back element associated with it.
Figure 6:
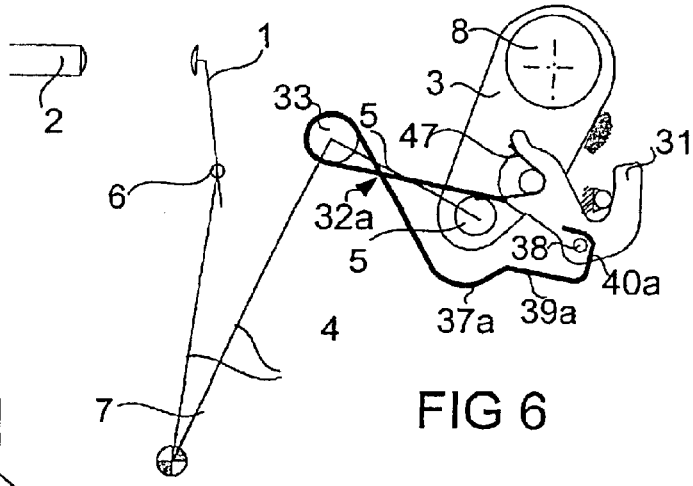
Figure 7:
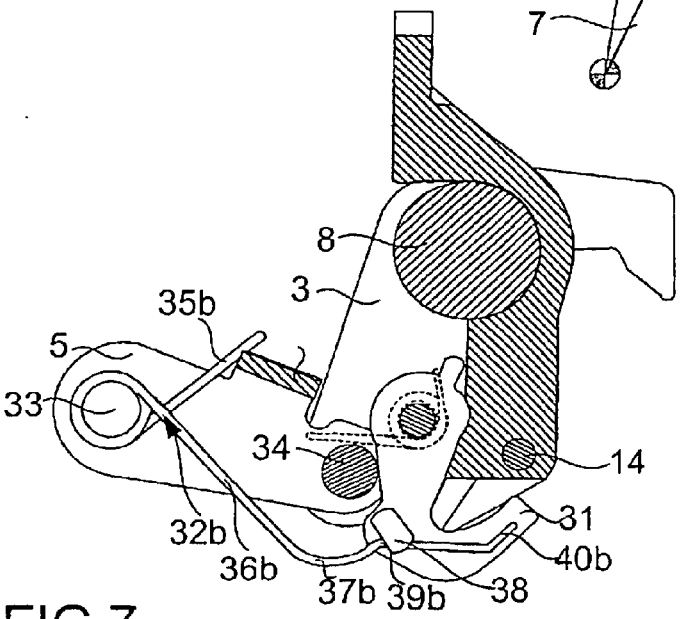

As can be seen from FIGS. 5 to 7, the hold-back element which is additionally associated with the catching element 31 is in the form of a hairpin-like spring clip, whose turns surround the first coupling bolt 33. In the case of a first refinement 32*a* of this spring clip (see FIGS. 5 and 6), a first limb 35*a* of the hold-back spring is in this case supported on the second coupling bolt 34. In the second embodiment 32*b* of the spring clip as illustrated in FIG. 7, the first limb 35*b* is supported on the coupling member 5. A second, self-supporting limb 36*a*; 36*b*, which is associated with the catching element 31, of the two spring limbs has a section 37*a*; 37*b* in the form of a circular arc. During the opening process, during which the elements of the drive train may be accelerated non-uniformly, a pin 38 which is arranged on the catching element 31 runs into this section which is in the form of a circular arc. In this case, the spring force of the spring clip is of such a magnitude that the catching hook is securely held in its rest position opposite the coupling element until the coupling element reaches a predetermined position, without restricting the opening process.

The section 37*a*; 37*b* which is in the form of a circular arc is adjacent to an angled further section 39*a*, 39*b* of the second limb, in such a way that the spring force of the spring clip transmits an additional torque in its pivoting direction to the catching element at the moment when the coupling element 3 strikes the stop 12. The end 40*a*; 40*b* of the second limb is shaped such that the catching hook can pivot freely in its pivoting direction and, in the process, forms a side guide surface for the spring clip. In consequence, the spring clip is at the same time held securely under the pin, and thus in its correct position.

Figure 8:
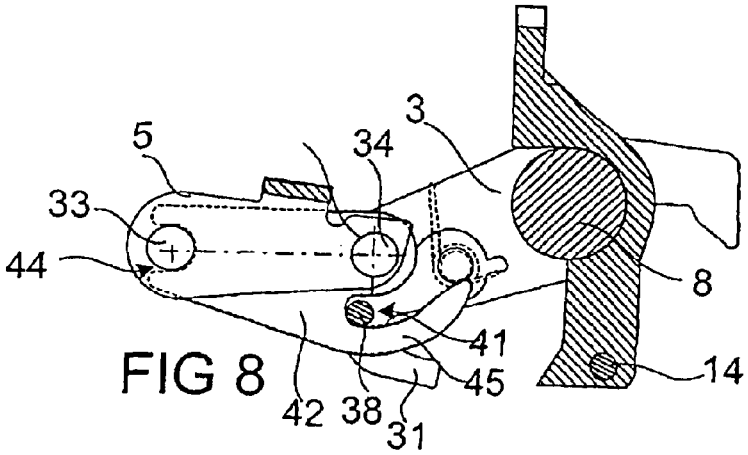
Figure 9:
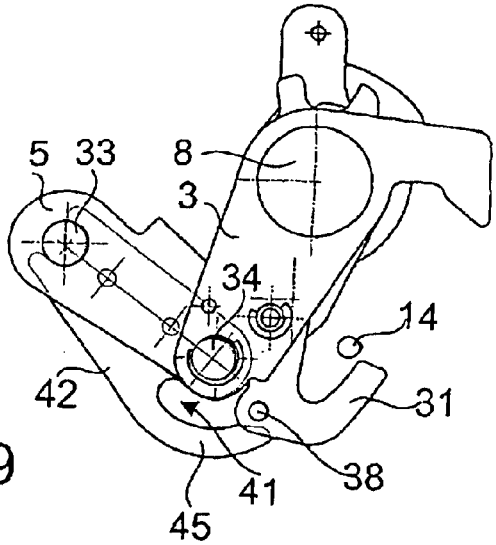
Figure 10:
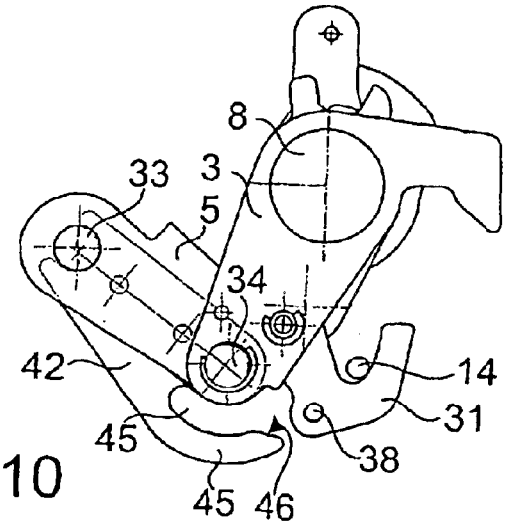

As can be seen from FIGS. 8 to 10, the hold-back element according to an alternative embodiment is in the form of a rigid part 42, which is provided with a slotted-link guide 41 and is held on the coupling member 5 of the drive train. In this case, the second coupling bolt 34 passes through the part 42 in the region of a hole 43, and the first coupling bolt 33 passes through the part 42 in the region of a recess 44, which is in the form of an elongated hole. The pin 38 which is arranged on the catching element is guided in the slotted-link guide 41. The slotted-link guide, which is curved in the form of a circular arc, crosses the pivoting path of the catching element at the start of the opening process in such a way that it is held opposite the coupling element and cannot be deflected prematurely in an uncontrolled manner. Only when the coupling element has reached a predetermined position, shortly before it strikes the stop, will the hold-back element have been moved sufficiently with respect to the catching element that the slotted-link guide coincides with the pivoting path of the catching element, so that the catching element can move to its catching position, after the striking process.

The rigid part 42 has a sliding surface 46 at the end of a cantilever arm 45, which forms the lower edge of the slotted-link guide, via which sliding surface 46 the pin which is arranged on the catching element is once again inserted into the slotted-link guide as soon as the catching element has been drawn back to its rest position on the coupling element once again, by the force of the resetting spring 47.

The new drive train allows the movement of the catching element to be controlled when external vibration or bumps act on the switch, thus reliably preventing bouncing of the coupling element.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A drive train for an opening and closing process for a moving contact of a switching contact arrangement of an electrical switch, comprising:

a coupling element, arranged between the moving contact and an associated drive element and movable against a stop at the end of the opening process;

a bouncing protection device associated with the coupling element, wherein the bouncing protection device includes a catching element arranged on the coupling element and pivotable by its inertia against a force of a resetting spring, from a rest position opposite the coupling element to a catching position; and a fixed-position opposing piece, wherein the catching element is additionally associated with a hold-back element, on which the catching element is guided during the opening and closing process and, in the process, is held in the rest position opposite the coupling element until the coupling element reaches a predetermined position.

2. The drive train as claimed in claim 1, wherein the catching element is in the form of a single-armed lever, and wherein the lever is engageable behind the opposing piece.

3. The drive train as claimed in claim 2, wherein the hold-back element is in the form of a spring.

4. The drive train as claimed in claim 3, wherein, once the coupling element has moved through a predetermined position, the catching element is accelerated by the spring in the direction of the catching position.

5. The drive train as claimed in claim 3, wherein, once the coupling element strikes the stop, the catching element is accelerated by the spring in the direction of the catching position.

6. The drive train as claimed in claim 2, wherein the hold-back element is in the form of a rigid part, provided with a slotted-link guide and wherein the hold-back element is held on the drive train.

7. The drive train as claimed in claim 2, wherein the hold-back element is in the form of a rigid part, provided with a slotted-link guide and wherein the hold-back element is held on a coupling member which is hinged on the coupling element.

8. The drive train as claimed in claim 1, wherein the hold-back element is in the form of a spring.

9. The drive train as claimed in claim 8, wherein, once the coupling element has moved through a predetermined position, the catching element is accelerated by the spring in the direction of the catching position.

10. The drive train as claimed in claim 8, wherein, once the coupling element strikes the stop, the catching element is accelerated by the spring in the direction of the catching position.

11. The drive train as claimed in claim 1, wherein the hold-back element is in the form of a rigid part, provided with a slotted-link guide and wherein the hold-back element is held on the drive train.

12. The drive train as claimed in claim 11, wherein two coupling bolts pass through the rigid part, with one coupling bolt coupling the coupling member to a contact lever support to which the moving contact is fitted, and the other coupling bolt coupling the coupling member to the coupling element.

13. The drive train as claimed in claim 1, wherein the lever is hook-shaped.

14. The drive train as claimed in claim 1, wherein the hold-back element is in the form of a rigid part, provided with a slotted-link guide and wherein the hold-back element is held on a coupling member which is hinged on the coupling element.

15. A drive train for an opening and closing process for a moving contact of a switching contact arrangement of an electrical switch, comprising:

coupling means, arranged between the moving contact and an associated drive element, for moving against a stop at the end of the opening and closing process;

a bouncing protection device, associated with the coupling means and including catching means, arranged on the coupling element, for pivoting by its inertia against a force of a resetting spring, from a rest position opposite the coupling means to a catching position; and a fixed-position opposing piece, wherein the catching means is additionally associated with a hold-back element, on which the catching means is guided during the opening process and, in the process, is held in its rest position opposite the coupling means until the coupling element reaches a predetermined position.

16. The drive train as claimed in claim 15, wherein the catching means includes a single-armed lever, and wherein the lever is engageable behind the opposing piece.

17. The drive train as claimed in claim 15, wherein the hold-back element is in the form of a spring.

18. The drive train as claimed in claim 17, wherein, once the coupling means has moved through a predetermined position, the catching means is accelerated by the spring in the direction of the catching position.

19. The drive train as claimed in claim 15, wherein the hold-back element is in the form of a rigid part, provided with a slotted-link guide and wherein the hold-back element is held on the drive train.

20. The drive train as claimed in claim 19, wherein two coupling bolts pass through the rigid part, with one coupling bolt coupling the coupling member to a contact lever support to which the moving contact is fitted, and the other coupling bolt coupling the coupling member to the coupling means.

* * * * *